US011253864B2

(12) United States Patent
Burhorst

(10) Patent No.: US 11,253,864 B2
(45) Date of Patent: Feb. 22, 2022

(54) FINE COMMINUTOR

(71) Applicant: Hugo Vogelsang Maschinenbau GmbH, Essen (DE)

(72) Inventor: Torsten Burhorst, Essen Oldenburg (DE)

(73) Assignee: HUGO VOGELSANG MASCHINENBAU GMBH, Essen (DE)

( * ) Notice: Subject to any disclaimer, the term of this patent is extended or adjusted under 35 U.S.C. 154(b) by 307 days.

(21) Appl. No.: 16/334,485

(22) PCT Filed: Sep. 20, 2017

(86) PCT No.: PCT/EP2017/073793
§ 371 (c)(1),
(2) Date: Mar. 19, 2019

(87) PCT Pub. No.: WO2018/054982
PCT Pub. Date: Mar. 29, 2018

(65) Prior Publication Data

US 2019/0210034 A1 Jul. 11, 2019

(30) Foreign Application Priority Data

Sep. 20, 2016 (DE) ..... 202016105242.4

(51) Int. Cl.
*B02C 18/00* (2006.01)
*B02C 18/18* (2006.01)
(Continued)

(52) U.S. Cl.
CPC ..... *B02C 18/0092* (2013.01); *B02C 18/06* (2013.01); *B02C 18/16* (2013.01); *B02C 18/18* (2013.01); *B02C 2018/188* (2013.01)

(58) Field of Classification Search
CPC .. B02C 7/04; B02C 7/12; B02C 13/28; B02C 18/0084; B02C 18/0092; B02C 18/06;
(Continued)

(56) References Cited

U.S. PATENT DOCUMENTS 2,853,248 A * 9/1958 Long ..... E03C 1/2665 241/46.013
3,249,310 A * 5/1966 Willems ..... B02C 2/10 241/29
(Continued)

FOREIGN PATENT DOCUMENTS

CN 85106294 4/1987
CN 103260764 8/2013
(Continued)

*Primary Examiner* — Edward T Tolan
*Assistant Examiner* — Jared O Brown
(74) *Attorney, Agent, or Firm* — Price Heneveld LLP

(57) ABSTRACT

A comminution device comprises a plurality of first cutting elements having first serrated cutting edges disposed on a first circular path; a second cutting element having a second serrated cutting edge corresponding to the first serrated cutting edges for cutting through cutting material, the second cutting element being displaceable about an axis of rotation on a second circular path concentric with the first circular path. The second serrated cutting edge comprises a plurality of jags and each jag comprises a radially inner flank and a radially outer flank, each at an angle to the axis of rotation. A drive rotationally drives the second cutting element about the axis of rotation and an adjustment mechanism by which the plurality of first cutting elements and the second cutting element are displaceable relative to each other axially in the direction of the axis of rotation, that a cutting gap between them is adjustable.

23 Claims, 8 Drawing Sheets

(51) Int. Cl.
*B02C 18/16* (2006.01)
*B02C 18/06* (2006.01)

(58) Field of Classification Search
CPC ..... B02C 18/062; B02C 18/16; B02C 18/18; B02C 18/182; B02C 2018/188; B02C 2201/06; B01F 7/00766; B01F 7/183; B01F 15/00909
USPC ..... 241/260, 261, 261.1, 261.3; 366/303
See application file for complete search history.

(56) References Cited

U.S. PATENT DOCUMENTS

| | | | | |
|---|---|---|---|---|
| 3,940,115 | A | 2/1976 | Zipperer | |
| 5,833,152 | A | 11/1998 | Galanty | |
| 6,012,662 | A | 1/2000 | Sulllivan | |
| 6,109,551 | A | 8/2000 | Sullivan | |
| 6,334,584 | B1 * | 1/2002 | Bauer, Jr. | B02C 7/04 241/259.1 |
| 6,357,682 | B1 * | 3/2002 | Hext | B02C 18/141 241/161 |
| 6,811,106 | B2 * | 11/2004 | Aikawa | D21D 1/38 241/261.1 |
| 8,789,778 | B2 | 7/2014 | Abeln | |
| 9,073,056 | B2 | 7/2015 | Abeln | |
| 9,120,100 | B2 | 9/2015 | Kim et al. | |
| 2003/0071153 | A1 * | 4/2003 | Aikawa | D21D 1/30 241/246 |
| 2008/0302890 | A1 | 12/2008 | Misawa et al. | |
| 2012/0037740 | A1 | 2/2012 | Galanty | |

FOREIGN PATENT DOCUMENTS

| | | | |
|---|---|---|---|
| CN | 104324778 | | 2/2015 |
| DE | 1819645 | | 10/1960 |
| DE | 1284267 | | 11/1968 |
| DE | 2139497 | | 2/1973 |
| DE | 7234578 | | 2/1973 |
| EP | 2613884 | B1 | 9/2011 |
| EP | 2586531 | | 5/2013 |
| EP | 2613884 | | 7/2013 |
| JP | S4829058 | A | 4/1973 |
| JP | S6014834 | A | 1/1985 |
| JP | 05-068902 | | 3/1993 |
| JP | 2012521285 | A | 9/2012 |
| JP | 2013532056 | A | 8/2013 |
| JP | 2013537103 | A | 9/2013 |
| KR | 101636540 | | 7/2016 |
| WO | 2010053800 | | 9/2010 |

* cited by examiner

FINE COMMINUTOR

CROSS-REFERENCE TO FOREIGN PRIORITY APPLICATION

The present application claims the benefit under 35 U.S.C. §§ 119(b), 119(e), 120, and/or 365(c) of PCT/EP2017/073793 filed Sep. 20, 2017, which claims priority to German Application No. 202016105242.4 filed Sep. 20, 2016.

FIELD OF THE INVENTION

The invention relates to a comminution device having first and second cutting elements which are rotatable relative to each other.

BACKGROUND OF THE INVENTION

A generic comminution device is known, for example, from EP 2 613 884 B1. Such cutting devices are used to comminute solids, solid masses, or liquids containing solids and are used in particular as a so-called wet comminutor, for example, in the food industry, in the preparation of bio-suspensions for further energetic use, or to prepare flowable mixtures mixed with solids in other agricultural uses and, in this case, to comminute the solids contained therein.

A further such cutting device is known from PCT/EP 2010/053800. In this prior art comminution device, the first and second cutting element are formed by a fixed, circular perforated disc on the one hand and a blade rotating around the central axis of the perforated disc, which blade abuts with a cutting edge on the surface of the perforated disc. The mass to be comminuted is pressed through the holes in the perforated disc, or flows through said holes and in this case, solids passing through the holes are comminuted by a shearing action between the blade edge and an edge delimiting the respective hole.

However, it has been shown that such comminutors are indeed well suited to provide a coarse comminution, and they have also been proven largely in practice, but there is a need for some processes to further comminute the material. This applies, for example, to materials that are difficult to ferment, such as long-fibre materials, manure, or grass silage. Although the known comminutors can cut the fibres, a comminution into very short fibre parts is generally not possible.

To address this problem, the present invention seeks to provide a comminution device of the type mentioned above, with which a fine comminution of difficult to ferment material, such as long-fibre material, manure, or grass silage, is effectively and efficiently possible.

SUMMARY OF THE INVENTION

This object is achieved with a comminution device of the type mentioned above in that it comprises: a plurality of first cutting elements having first serrated cutting edges disposed on a first circular path; at least one second cutting element having a second serrated cutting edge corresponding to the first serrated cutting edges for cutting through cutting material, the second cutting element being displaceable about an axis of rotation on a second circular path concentric with the first circular path, the second serrated cutting edge comprising a plurality of jags and each jag comprising a radially inner flank and a radially outer flank, which are each at an angle to the axis of rotation; a drive for rotatably driving the second cutting element about the axis of rotation; and an adjustment mechanism by means of which the plurality of first cutting elements and the second cutting element are axially displaceable in the direction of the axis of rotation relative to each other such that a cutting gap between them is adjustable.

On the one hand, the invention is based on the insight that the implementation of the cutting elements having serrated cutting edges is advantageous for the comminution of fibrous material. On the other hand, the entire length of the cutting edges is increased by the implementation of serrated cutting edges and thus also increases the cutting action. The circular disposition of the plurality of first cutting elements serves the purpose of efficient cutting through when the second cutting element rotates. The plurality of first cutting elements acts in addition as a sieve, so that material not divided is retained and can only pass through after being divided by the first cutting elements. The term "plurality" in the present application always means that two or more of these elements are present. Further, the invention is based on the idea that the cutting gap between the first and second cutting edges is adjustable. This is particularly advantageous in order to divide material according to the needs, coarser or finer. The cutting gap in this case can be reduced to a minimum, so that the cutting elements abut each other directly. A particularly fine comminution is thereby achieved. The cutting gap can also be adjusted positively, so that the cutting elements rotate at a distance to each other. A less fine comminution takes place here, which is particularly suitable for coarser materials or good fermentable materials.

A first adjustment mechanism is provided according to the invention for adjusting the cutting gap. The first and second cutting elements can be displaced axially relative to each other with the adjustment mechanism. That is, it is, on the one hand, possible to displace only the second cutting element axially, while the plurality of first cutting elements is stationary. This variant is particularly preferred since this achieves a simple construction. In other variants, however, it can also be provided that the second cutting element is stationary, while the plurality of first cutting elements is displaced relatively along the axis of rotation.

In a further embodiment, it is provided that both cutting elements are to be displaced towards each other. Preferably, a plurality of second cutting elements are provided, in particular, two, four, six, or eight second cutting elements. Said elements are preferably disposed uniformly distributed on the circular path, whereby a uniform comminution also takes place and centrifugal forces are balanced on a drive shaft of the drive.

The second cutting elements preferably comprise a plate-shaped body, which is preferably disposed with its main plane parallel to the axis of rotation. In variants, it can also be provided that the main plane runs at an angle to the axis of rotation, so that due to the inclination of the second cutting elements, a screw conveyance for fluid can be provided, so that a flow is caused.

It is further provided that the second serrated cutting edge comprises a plurality of jags, and each jag comprises a radially inner flank and a radially outer flank, which are each at an angle to the axis of rotation. Preferably, the second cutting edge comprises two, three, four, five, six, seven, eight, nine, or ten jags. The number of jags depends, in particular, on the volume flow to be processed. The flanks can be curved or straight. Straight flanks have the advantage of a simplified production, and also a regrinding of the cutting elements can be performed in a simple manner. The first and second cutting edges correspond to each other, so that the described geometry of said jags of the second cutting edge also applies correspondingly to the first cutting edge. This, accordingly, comprises jags, wherein each tip of said jags of the second cutting edge engage in valleys between jags of the first cutting edge. The cutting gap preferably comprises a substantially constant width along the entire cutting edge.

In a first preferred embodiment, the jags are disposed on a path running at an angle to the axis of rotation. The cutting of the material thus does not take place in a plane, but rather on a frusto-conical surface or conical surface. The path preferably comprises an angle to the axis of rotation in a range of 45° to 70°, in particular, about 60°. This has the particular advantage that material can enter axially into the comminution device and then can flow out of it radially. An advantage here is that the disposition of the motor is simplified; this can be disposed axially and be equipped with a short shaft. It is not necessary that the cut-through material flows around the drive shaft of the motor.

Furthermore, it is preferable that the angle of the outer flanks and the inner flanks is different. This results in a different cutting gap width for the inner and outer edges when changing the cutting gap through axial displacement, since, during axial displacement, a larger angle to the axis of rotation leads to a larger difference in the cutting gap, than a small, acute angle. As a result, the cutting gap on the radially outer flank and the radially inner flank can be adjusted differently. In variants, however, it can also be provided that the angles of the inner and outer edges are equal.

In a further preferred embodiment, it is provided that the angle of the outer flank, at least in some of the plurality of jags, is greater than the angle of the inner flank. This is particularly advantageous when the adjustment mechanism is used to make wear adjustment. It has been found that the radially outer flanks wear out faster, also due to a radially outward flow and centrifugal forces. If the angles are flatter on the outside, a stronger readjustment, that is, gap narrowing during axial displacement, can be carried out here.

Furthermore, it is preferred that the angle of the radially outer flank of at least one radially outer jag is greater than the angle of the radially outer flank of a radially inner jag. This means that a jag lying radially further out comprises a flatter edge than a radially inward jag. The same applies here, which has already been discussed above. The jags, which lie radially outward, are generally exposed to higher wear, on the one hand due to centrifugal force, on the other hand, due to higher cutting speeds. Jags lying radially outward are displaced at a higher path speed than radially inward jags, whereby the wear can be increased. By providing flat angles, a higher infeed takes place during the axial adjustment, and the cutting gap can be kept substantially constant over the service life of the cutting elements. The gap here is measured perpendicular to the flank plane.

In this case, it can preferably be provided that the angle of the radially outer flanks of the radially outer jags is in each case greater than the angle of the radially outer flanks of the radially inner jags. That is, the farther outward a jag lies, the flatter the angle. Preferably, the angle should change continuously. There is preferably a gradual change in angle from the radially inner jags to the radially outer jags instead.

According to a further preferred embodiment, it is provided that the radially outer flank of at least one jag is longer than the radially inner flank of said jag. Preferably, this is provided at two, three, four, five, or preferably all jags. As a result, the disposition of the jags on a path which is at an angle to the axis of rotation, is simplified and extended radially outside the cutting edge.

According to a particularly preferred embodiment, the second cutting element is mounted on an axially displaceable hub, wherein the first adjustment mechanism comprises a device for determining an axial position of the hub. The hub is preferably supported on a drive shaft, which is coupled to the drive, in particular, an electric motor. The hub is attached in an axially relocatable shaft-hub connection on this, for example, using a feather key. The axial position of the hub is determined by means of the first adjustment mechanism, and thus a distance between the first and second cutting elements is determined. The first cutting elements are preferably disposed stationary according to this embodiment, based on the axial position of the drive shaft. For example, the first cutting elements can be permanently coupled to a housing in which the drive shaft is also supported.

Preferably, the device comprises a first screw for defining the axial position of the hub and a lock screw for fixing the axial position. The axial position is preferably adjusted by means of the first screw. The first screw preferably extends through a segment of the hub, and is supported on the drive shaft. Also, the reverse case, in which the screw is guided by a threaded segment in a shaft segment, and is supported on the hub, is preferred. Again, other variants are conceivable. It can also be provided that the hub itself is disposed with a thread on the shaft and in this way is axially adjustable to the shaft. To determine this position, according to this embodiment, a further lock screw is provided, which can be implemented in the form of a nut on the first screw, or in the form of a deadlock, which results in that the first screw can not be further rotated. Both of the first screw and the lock screw are preferably a plurality, provided preferably around the circumference of the hub. As a result, a uniform power transmission is ensured.

According to a further preferred embodiment of the invention, the comminution device further comprises a plurality of third cutting elements having third serrated cutting edges disposed on a third circular path. Preferably, the third circular path is concentric with the first circular path and has the same diameter. Preferably, the plurality of third cutting elements is implemented substantially mirror-symmetrically to the plurality of first cutting elements, in particular to a plane perpendicular to the axis of rotation.

At the same time, it is preferred here that the second cutting element comprises a fourth serrated cutting edge which corresponds to the third serrated cutting edges for cutting through cutting material. Alternatively, it is also conceivable that at least one fourth cutting element is provided which comprises the fourth cutting edge. Preferably, however, the fourth cutting edge is implemented on the second cutting element, so that the second cutting element comprises a total of two cutting edges, namely the second cutting edge and the fourth cutting edge. The second cutting element is thus implemented double-edged. The same applies as defined above to the second cutting edge with respect to the serrated shape of the fourth cutting edges. In this respect, reference is made in full to the above description of the second cutting edge.

Also, the second cutting edge and the fourth cutting edge are preferably implemented substantially mirror-symmetrical. The plane of symmetry is preferably disposed substantially perpendicular to the axis of rotation. A uniform cutting takes place on both sides of the second cutting element by a symmetrical implementation, so that the cutting between the first and second cutting edge and the third and fourth cutting edge runs uniformly. As a result, the wear on both sides is approximately uniform, whereby the maintenance is simplified.

According to a further preferred embodiment, by means of a second adjustment mechanism, the plurality of third cutting elements and the second cutting element are axially displaceable in the direction of the axis of rotation relative to each other such that a cutting gap between them is adjustable. Consequently, the cutting gap between the third and fourth cutting edges is adjustable, namely by means of the second adjustment mechanism. When the second cutting element is mounted stationary, it is necessary for the plurality of first cutting elements and the plurality of third cutting elements to be displaced axially substantially uniformly toward the second cutting element in order to uniformly implement the cutting gap between the first and second cutting edges and the third and fourth cutting edges.

In a preferred variant of the invention, however, the plurality of first cutting elements is mounted stationary and the second cutting element is to be displaced relative to the first cutting elements. Therefore, it is required that the plurality of third cutting elements is fed in axially twice in order to uniformly implement a cutting gap narrowing. It is preferably provided that the second adjustment mechanism takes this into account and always provides a double infeed of the third cutting elements.

Preferably, the third cutting elements are mounted in a housing, wherein the second adjustment mechanism comprises a device for determining the axial position of the housing. Preferably, the device for determining the axial position of the housing comprises a first screw for defining the axial position of the housing and a lock screw for fixing the axial position of the housing. The second adjustment mechanism is therefore implemented similar to the device for adjusting the first cutting gap described above. It can be provided that the thread of the screw for defining the axial position of the housing has a double thread pitch, like the screw for defining the axial position of the hub. It is then sufficient to adjust the screws in the same sense to provide a double infeed for the third cutting elements.

According to a further preferred embodiment of the invention, the comminution device further comprises a pre-comminutor disposed upstream of the first and second cutting elements, and comprising: a first pre-cutting element comprising at least one first precut edge, and a second second pre-cutting element which can be displaced on a fourth circular path relative to the first pre-cutting element, comprising at least one second precut edge, wherein the second pre-cutting element is coupled to the drive, for displacing together with the second cutting element. The pre-comminutor is preferably implemented substantially the same as the comminution device described in EP 2 613 884. By the coupling of the pre-comminutor to the drive shaft which drives the second cutting element, a pre-comminution by the first and second pre-cutting elements additionally takes place before the fine comminution, which is performed through the first, second and optionally third cutting elements according to the invention. In such an embodiment, it is possible to also directly finely comminute coarse material with a single comminution device, since the comminution device comprises two comminution stages. Only a single drive is required due to the coupling the two comminution stages.

In a preferred refinement, the second cutting element is disposed at an angle to the axis of rotation. This preferably applies to all second cutting elements of the comminution device. Preferably, all second cutting elements are disposed at an angle in the same direction. The second cutting elements are preferably substantially plate-shaped, so that a plane of the plate-shaped cutting element is disposed at an angle. The cutting jags are preferably also disposed at an angle to the cutting element in this embodiment, so that the cutting jags preferably define a plane which is perpendicular to the axis of rotation.

The inclination of the second cutting elements achieves a more uniform load since the individual cutting jags engage successively and not simultaneously. As a result, the current consumption of the drive can be made much more uniform, since a fluctuation of the load torque is reduced. Furthermore, the service life can be increased through this embodiment, in particular, that of any gearbox, and also noise development can be reduced.

Preferably, the at least one second cutting element encloses an angle with the axis of rotation, which angle is in a range of >0° to 90°, preferably >0° to 45°, more preferably 5° to 45°. It has been found that even a slight inclination can be sufficient to achieve the above effects. An angle of 45° is optimal for many applications.

It is further preferred that the second cutting element is mounted on a hub, wherein the hub comprises at least one radial recess having a mounting surface disposed at an angle to the axis of rotation, wherein the second cutting element is mounted on the mounting surface. The second cutting elements can be kept structurally simple in this way. It is advantageous when the second cutting elements are as simple as possible, since they wear out and have to be replaced. Cost-effective production is therefore particularly preferred. The increased complexity that occurs due to the inclination is transmitted to the hub according to this embodiment example, which hub usually does not need to be replaced. The inclination of the mounting surfaces of the hub preferably defines the inclination of the second cutting elements.

In a preferred refinement, the at least one second cutting element comprises a passage for reducing a flow resistance. This is particularly preferred when the second cutting elements are plate-shaped. As a result, the flow resistance is reduced and the energy requirement of the comminution device can be reduced. This is particularly preferred when the second cutting elements are disposed at an angle, since then preferably a cutting jag is always engaged.

BRIEF DESCRIPTION OF THE DRAWINGS

In the following, the invention is explained in more detail using two embodiment examples with reference to the associated figures. Shown are.

DETAILED DESCRIPTION OF THE EMBODIMENTS

Figure 1:
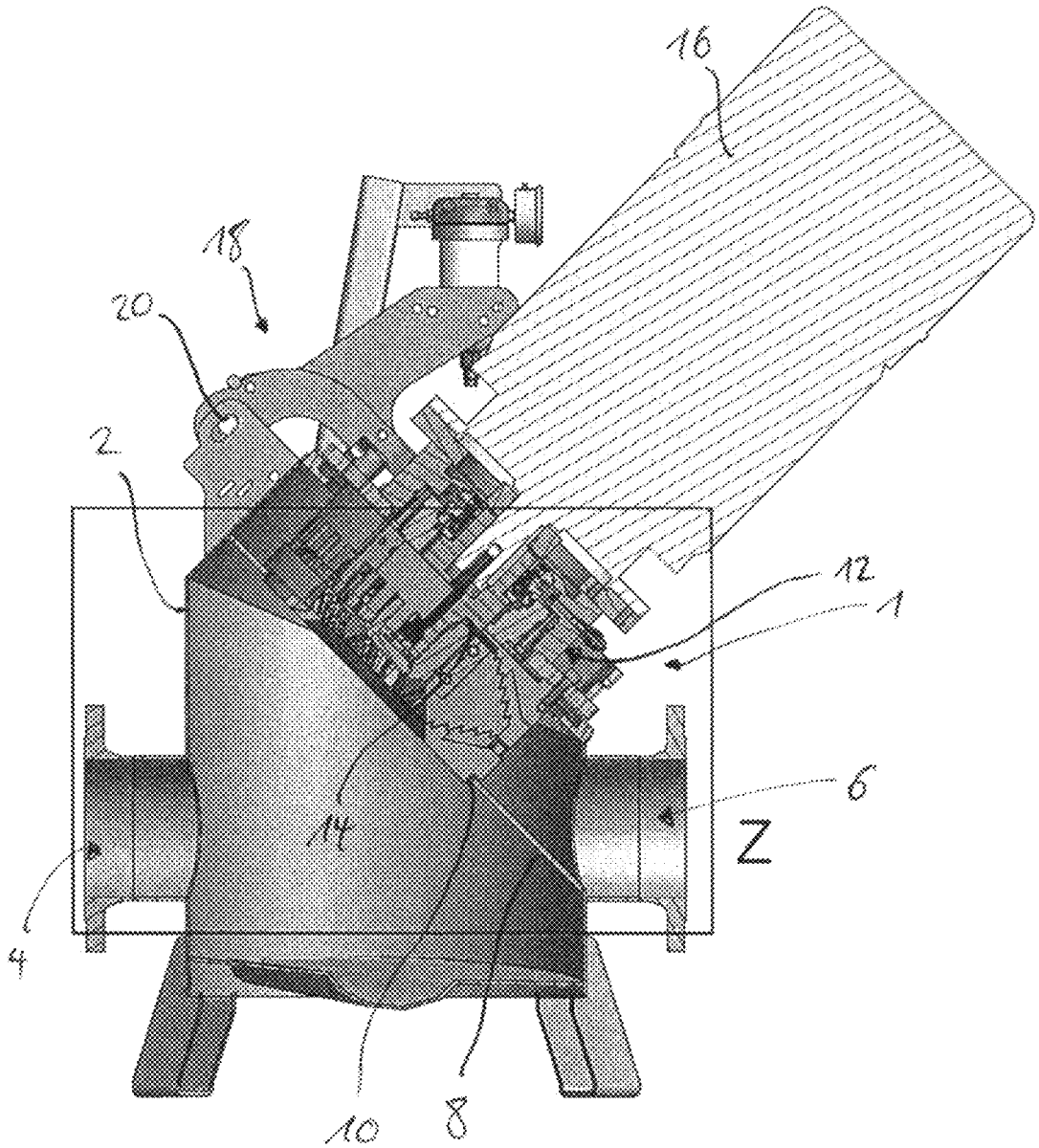
FIG. 1 is a section through a comminution device according to a first embodiment example in an installed state.

A comminution device 1 is disposed in a pot 2 of a pipe system. The pot 2 comprises an inlet 4 and an outlet 6, which can be flanged to corresponding tubes. Inside, the pot 2 comprises a separating plate 8 that separates inlet 4 and outlet 6 from each other. A passage 10 is implemented in the separating plate 8, in which passage the comminution device 1 is inserted. The comminution device 1 is described in more detail with reference to the further figures. It comprises a main housing 12, in which a drive shaft 14 is supported, which is coupled to a drive 16. The entire comminution device 1 is pivotally mounted on the pot 2 via a pivoting mechanism 18 and can be pivoted away from the pot 2 about a pivot point 20 with reference to FIG. 1. This is used to perform maintenance on the comminution device 1 and the pot 2, for example, in the event that individual parts are jammed there.

Figure 2:
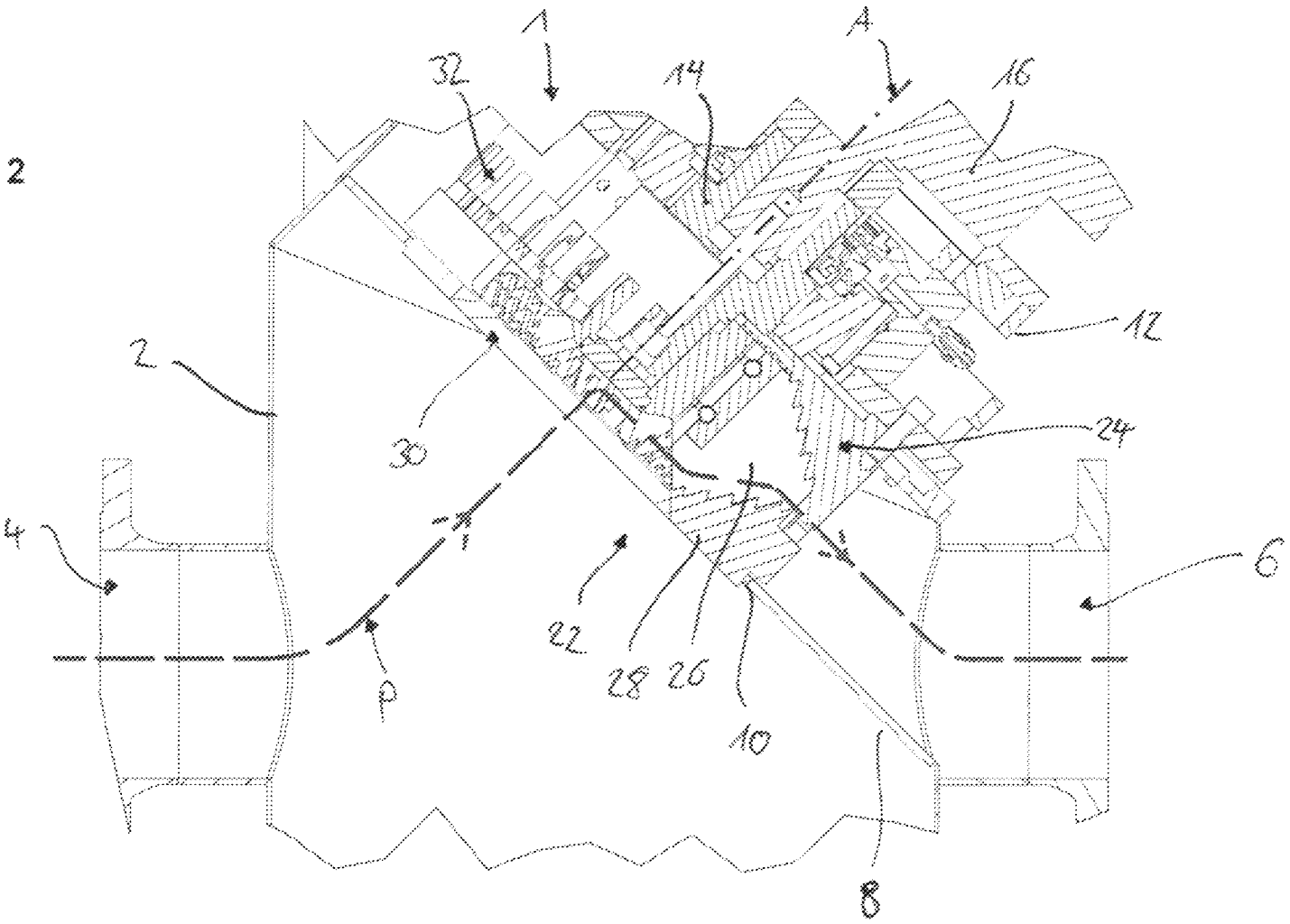
FIG. 2 is the detail Z of FIG. 1.

The comminution device 1 (see FIG. 2) comprises a cutting unit 22, in which a plurality of first cutting elements 24, at least one second cutting element 26 and, according to this embodiment, a plurality of third cutting elements 28 interact. In a lower segment, annularly surrounded by the third cutting elements 28, the cutting unit 22 comprises a circular inlet opening 30 through which material to be cut can enter the cutting unit 22. After the material has passed through the cutting unit, it can radially exit through gaps 32 (only one provided with reference numerals in FIG. 2) between the plurality of first cutting elements 24 and the plurality of third cutting elements 28. The flow path of the material is shown in FIG. 2 by the dashed arrow P. The material thus flows in through the inlet 4, then slightly upwards through the opening 30 into the cutting unit 22, exits there radially, passes thus comminuted behind the separating plate 8 and can flow out of the outlet 6. The slight upward flow of the material also has the task of separating off solid components not to be cut, such as stones and the like. These fall down and can then be removed from the bottom of the pot 2.

Figure 3:
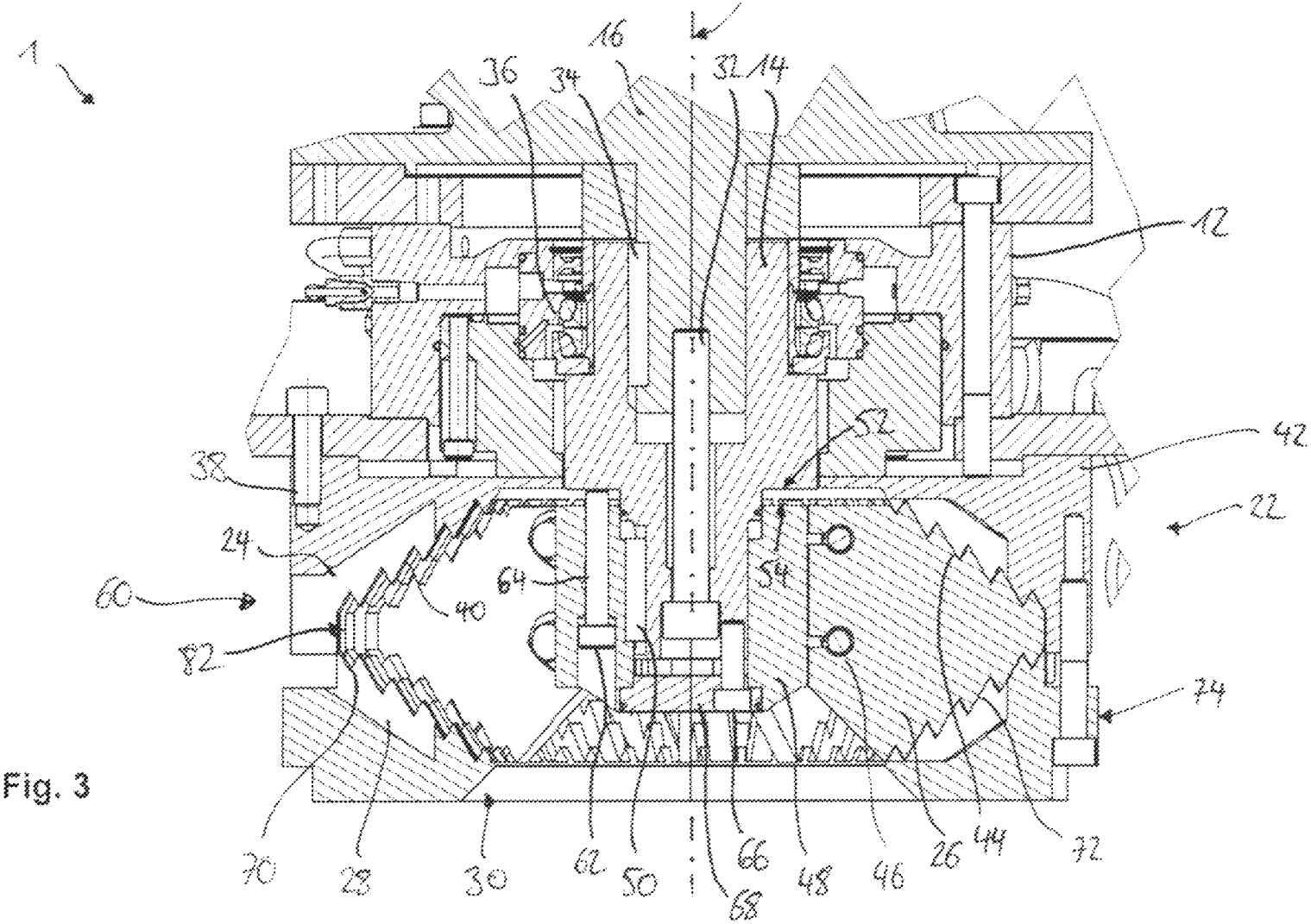
FIG. 3 is a section through the comminution device.
Figure 4:
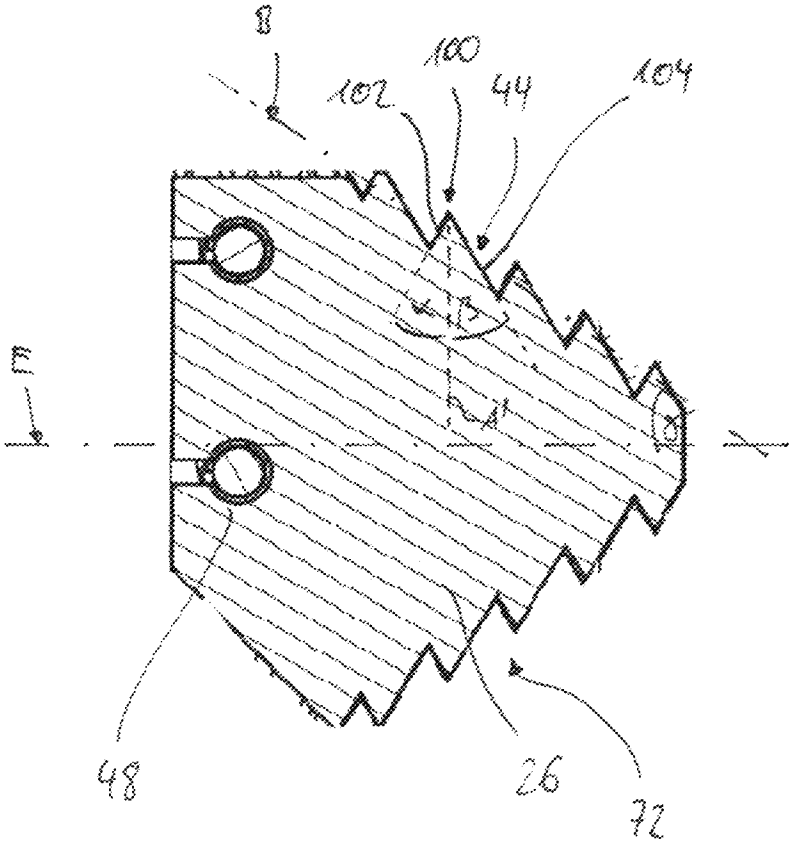
FIG. 4 is a detailed view of a second cutting element.
Figure 5:
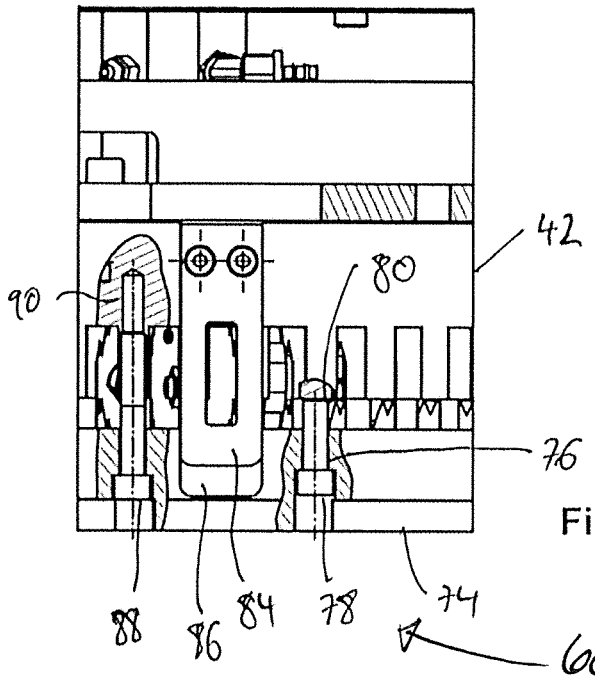
FIG. 5 is the section B-B according to FIG. 6.
Figure 6:
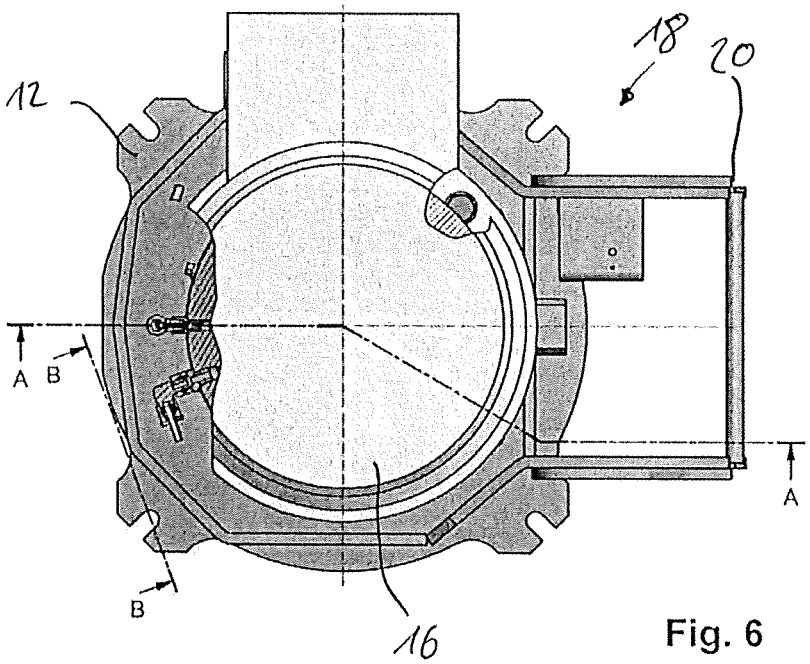
FIG. 6 is a plan view with partial breakout on the device according to FIG. 1.

With reference to FIGS. 3, 4, and 5, the cutting mechanism and the adjustment mechanism are now described in greater detail.

The drive 16 is disposed on the main housing 12. The drive shaft 14 is attached rotationally fixed to the drive 16 or an output shaft of the drive 16 (not shown in detail). On the one hand, a central screw 32 is provided for this purpose, and a feather key 34 to transmit rotational forces. The drive shaft 14 is supported by means of a bearing 36 on the main housing 12.

The plurality of first cutting elements 24 is initially attached on the front side against the main housing 12. A further screw connection 38 is provided for this purpose. The plurality of first cutting elements 24 is integrally implemented as a whole and the individual cutting edges 40 are milled out of a body, so that the cutting elements 24 comprise a common housing segment 42 and can be attached as a unit to the main housing 12. The cutting elements 24 are disposed on a circular path and each aligned with its main plane radially to the axis of rotation A. The central axis of the circular path is identical to the axis of rotation A.

A second cutting element 26 is provided corresponding to the first serrated cutting edge 40 of the first cutting elements 24. Overall, seven second cutting elements 26 are provided according to these embodiment examples, even though only one is provided with reference numeral 26. The second cutting element 26 comprises a second cutting edge 44 which is implemented serrated and corresponds to the first cutting edge 40. The second cutting element 26 is attached to a hub 48 via a clamping connection 46. The hub 48 is, in turn, supported axially on the shaft 14, wherein a feather key 50 is provided for the torque transmission. The hub 48 is axially relocatable in the direction of the axis of rotation A and thus a distance between a shaft shoulder 52 of the drive shaft 14 and an end face 54 of the hub 48 is provided. As is readily apparent from FIG. 3, it is possible to further push the hub 48 upwardly with respect to FIG. 3 so that the end face 54 comes into contact with the shoulder 52.

In the position of the hub 48 shown in FIG. 3, the cutting edges 40, 44 are aligned so that they substantially abut and form a cutting gap, which is only a few tenths of a millimetre. If there is wear on the cutting edges 40, 44, it may be necessary for an adjustment to be made. It is also conceivable that the cutting gap should be increased in order to provide a coarser comminution. For this purpose, the comminution device 1 according to the present invention comprises a first adjustment mechanism 60, which is now described.

The first adjustment mechanism 60 according to this embodiment first comprises the relocatable hub 48 which carries the second cutting element or elements 26. To adjust the axial position of the hub 48, a first screw 62 is provided according to this embodiment, which screw extends through a corresponding threaded hole 64 in the hub 48. As can be seen in FIG. 3, the foot of the screw 62 extends out to a certain extent from the end face 54 of the hub 48 and is in contact with the shaft shoulder 52. Likewise, the head of the screw 62 does not lie on the annular shoulder of the threaded hole 64, but has a certain distance therefrom. By the extent of the excess length of the screw foot from the end face 54, the distance of the end face 54 can thus be adjusted to the shaft shoulder 52 and thus defined. To fix this position, a lock screw 66 is provided which braces a cover 68 against the hub 48 and the drive shaft 14 and thus defines the hub 48. Although only a first screw 62 and a lock screw 66 are shown in FIG. 3, it should be understood that a plurality of such screws can be provided around the circumference of the hub 48 and the cover 68 to achieve uniform tensioning.

According to this embodiment (FIG. 3), it is further provided that the cutting unit 22 comprises a plurality of third cutting elements 28, which are formed substantially identically to the first cutting elements 24. Said cutting elements also comprise serrated cutting edges 70. The third cutting elements 28 are optional, but lead to a higher rate of comminution. The third cutting elements 28 according to this embodiment example correspond with a fourth cutting edge 72 of the second cutting element 26. The third cutting elements 28 are milled from a material and thus comprise a common housing 74. The inlet 30 is also defined through the housing 74.

The third cutting elements 28 are attached to the housing 42 of the first cutting elements 24 via the housing 74. The distance between the third cutting edges 70 and fourth cutting edges 72 is adjustable by means of a second adjustment mechanism 60'. For this purpose, threaded holes 76 are provided on the housing 74 (see FIG. 5), which have a similar principle as the threaded holes 64 of the screw 62. A screw 78 is inserted in the threaded hole 76, which screw is supported with its foot end against a stop 80 on the housing 42 of the first cutting elements 24. An outer diameter of the third cutting elements 28 is slightly smaller than an inner diameter of a segment 82 of the first cutting elements 24, so that the housing part 74 with the third cutting elements 28 can dip into the first housing part 42 with the first cutting elements 24. To guide the housing 74 during the axial adjustment by means of the screw 78, a guide tab 84 is provided, which engages in a recess 86. A further screw 88 is provided for determining and fixing the axial position, which screw engages in a threaded hole 90 on the housing 42 and so brace the two housing parts 72, 74 against each other and load the screw 78 on pressure.

A single second cutting element 26 is shown in FIG. 4, on which the geometry of said jags 100 can be seen. Only one jag 100 is provided with reference numerals in FIG. 4, but the other jags are also implemented. The jag 100 comprises two flanks 102, 104, wherein 102 refers to the radially inner flank, while 104 refers to the radially outer flank. The radially inner flank 102 encloses an angle α with the axis of rotation A or an axis A' running parallel thereto. A corresponding angle β encloses the flank 104 with the axis A'. The radially outer flanks 104 are longer than the radially inner flanks 102, so that the jags 100 are disposed in total on a path B, which is at an angle to the axis of rotation. In this embodiment example, based on a plane E perpendicular to the axis of rotation A, an angle γ is delineated approximately in the range of 30°.

The angle β of jags 100, which lie radially further outward, that is, with respect to FIG. 4 further right, is greater than the angle β of jags which lie radially further inward, that is, further left in FIG. 4. This has the effect that the flanks 104 of jags which lie radially further outward is flatter than of jags 100 which lie radially further inward. If now an axial distance between the second cutting elements 26 and the first cutting elements 24 is reduced, the distance between the flanks 104 which lie radially further outward, and the corresponding counter flanks at the cutting edges 40 becomes disproportionately smaller than the distance between the flanks 104, which lie radially further inward and the corresponding counter flanks, both seen as normal distance to the flank surface. This makes it possible to compensate for the higher wear on jags 100 lying radially further outward when a wear adjustment is made and an axial adjustment is performed for this purpose.

Figure 7:
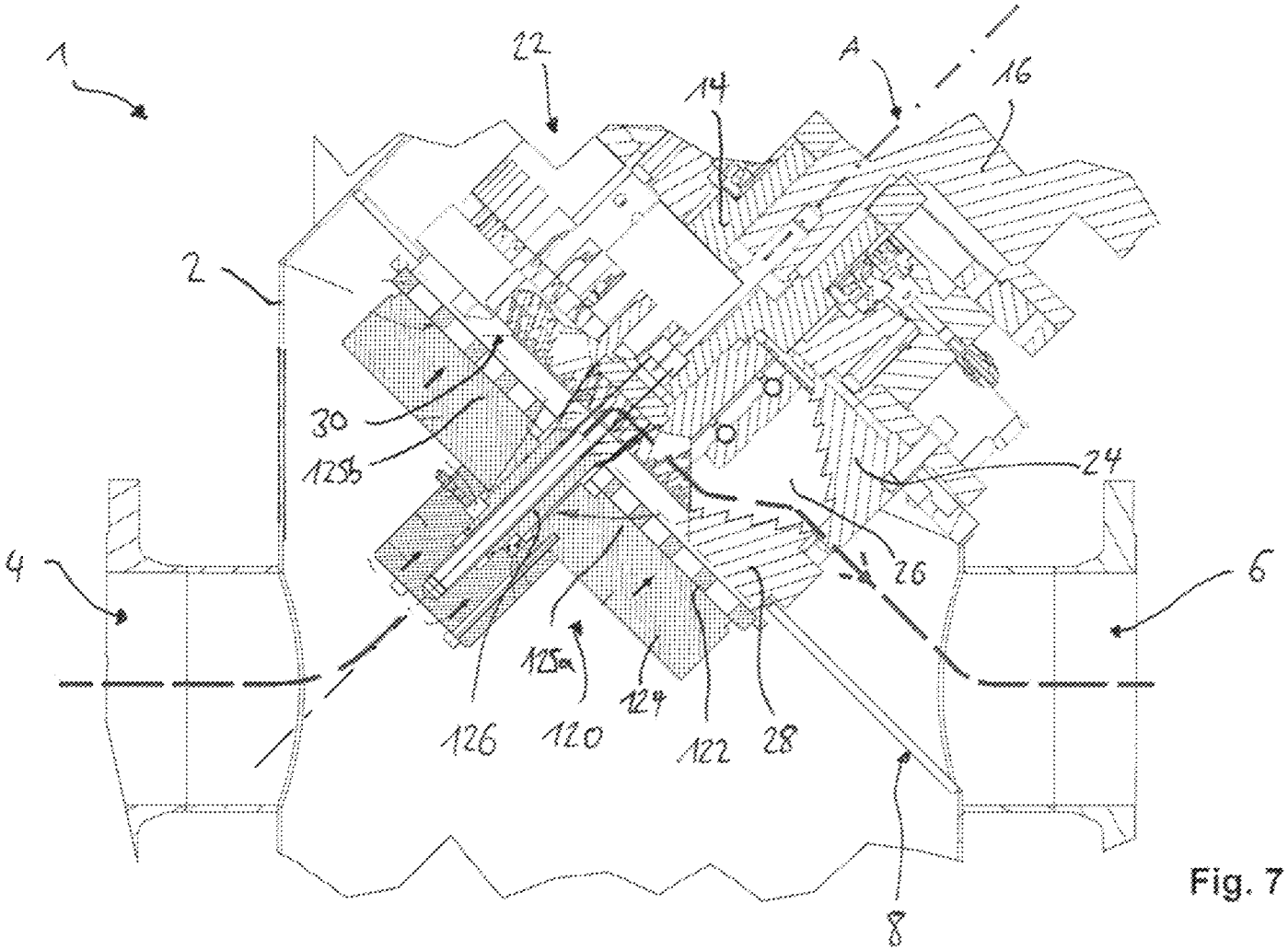
FIG. 7 is a comminution device in the installed state according to a second embodiment example.

A second embodiment example of the comminution device 1 is shown in FIG. 7. The same parts are provided with the same reference numerals, and to that extent, reference is made in full to the above description of the first embodiment example (see FIGS. 1-6).

In contrast to the first embodiment example (see, in particular, FIG. 2), the comminution device 1 according to this embodiment comprises a pre-comminutor 120. The pre-comminutor 120 comprises a first pre-cutting element 122 and a second pre-cutting element 124. The first pre-cutting element 122 is implemented as a perforated disc and mounted in front of the inlet opening 30. The second pre-cutting element 124 is a blade holder having a total of four blades 125*a*, 125*b* disposed thereon (only two blades can be seen in FIG. 7). The blade holder is connected via a shaft extension 126 to the drive shaft 14, so that the blade holder rotates together with the drive shaft 14, the hub 48 and thus also the at least one second cutting element 26. The pre-cutting element 122 is preferably implemented in accordance with the perforated disc from EP 2 613 884, and the second pre-cutting element 124 is preferably implemented like the blade holder from EP 2 613 884 B1. The edges of the holes of the perforated disc together with the blades 125*a*, 125*b* of the blade holder form corresponding cutting and material to be cut through can be separated thereon by rotation of the blade holder. Such a product is already known from the market and is sold by the patent proprietor under the name "RotaCut."

Figure 8:
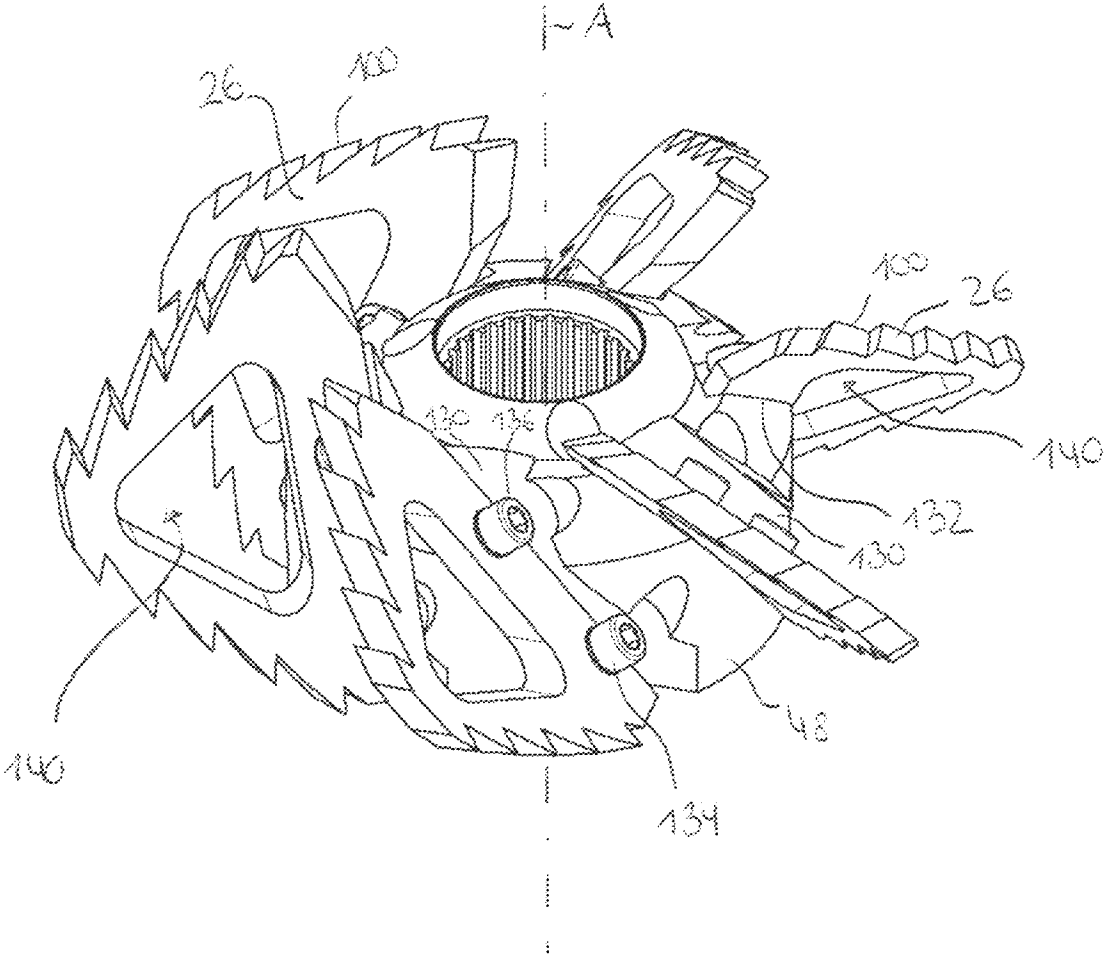
FIG. 8 is a perspective view of a hub together with second cutting elements of a comminution device according to a third embodiment example.
Figure 9:
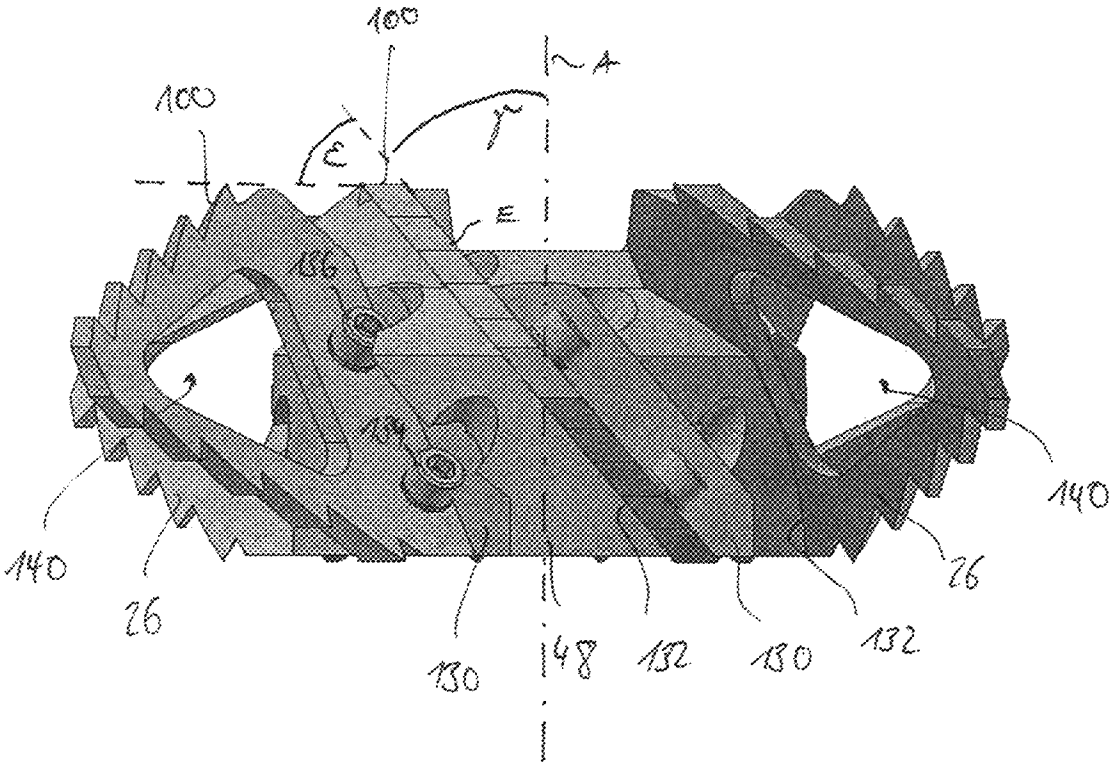
FIG. 9 is a side view of the hub of FIG. 8.

FIGS. 8 and 9 illustrate a third embodiment example. More specifically, in FIGS. 8 and 9, only the hub 48 and the second cutting elements 26 are shown. The remaining elements of the comminution device 1 are identical to the first two embodiment examples, so that they are not shown here for reasons of clarity. The unit shown in FIGS. 8 and 9 can, therefore, also be used in the comminution devices 1 of the first two embodiment examples (FIGS. 1-7).

The hub 48 comprises a plurality of radial recesses 130 which define a mounting surface 132. The respective second cutting elements 26 are mounted as said mounting surfaces 132. This is achieved in this third embodiment example by two screws 134, 136 each, which extend through corresponding through holes (not shown) on the second cutting elements 26 and are screwed on the hub 48 in internally threaded provided blind holes (not shown). As an alternative to said screw connection, other connections are conceivable and preferred, in particular, clamping and/or plug connections.

The second cutting elements 26 are all disposed at an angle with respect to the axis of rotation A. While the cutting elements 26 in the first embodiment examples lay together in a plane with the axis of rotation A or at least parallel thereto, they enclose an angle γ in this embodiment example (FIGS. 8 and 9). The angle γ is measured between a plane E defined by the plate-shaped second cutting elements and the axis of rotation A. The angle γ in the present embodiment example is approximately 45° (see FIG. 9). It can, however, also have a different value, which is preferably in a range of >0° to 90°. The individual cutting jags 100 are in turn preferably at an angle and indeed at a complementary angle ε (see FIG. 9), so that the cutting jags are aligned generally perpendicular to the axis of rotation A. This facilitates effective cutting. The inclination of the cutting jags 100 is best seen from the second cutting element 26, which is shown in the middle in FIG. 9 and on the basis of which the angles are plotted.

A further difference in this embodiment example lies in that the second cutting elements each comprise a passage 140. The passages 140 are basically implemented so that they are approximately adapted to the outer contour of the second cutting elements 26, but allow a sufficient wall thickness both for attaching the second cutting elements 26 to the hub 48, as well as a cutting. Different geometries are conceivable here in order to allow an efficient fluid flow, or even to positively influence said flow by the specific geometry of the passages 140. It should be understood that the passages 140 can also be provided at the second cutting elements 26 of the first two embodiment examples (FIGS. 1-7) and are only albeit optionally preferred in the third embodiment example (FIGS. 8 and 9).

The invention claimed is:

1. A comminution device, comprising:

a plurality of first cutting elements having first serrated cutting edges disposed on a first circular path; and at least one second cutting element having a second serrated cutting edge corresponding to the first serrated cutting edges for cutting through a cutting material, the second cutting element being displaceable about a rotational axis on a second circular path concentric with the first circular path, the second serrated cutting edge comprising a plurality of jags and each jag comprising a radially inner flank and a radially outer flank, each of the radially inner flank and the radially outer flank at an angle to the axis of rotation;

a drive for rotationally driving the second cutting element about the axis of rotation; and a first adjustment mechanism by which an axial position of the plurality of first cutting elements relative an axial position of the second cutting element is axially adjusted in the direction of the axis of rotation such that a first cutting gap between the first cutting elements and the second cutting element is adjustable;

wherein the radially outer flanks of the plurality of jags are longer than the radially inner flanks of said jags.

2. The comminution device according to claim 1, wherein the jags are disposed on a path running at an angle to the axis of rotation.

3. The comminution device according to claim 1, wherein the angle to the axis of rotation of the outer flanks and the angle to the axis of rotation of the inner flanks are different.

4. The comminution device according to claim 2, wherein the angle to the axis of rotation of the outer flanks of at least some of the plurality of jags is greater than the angle to the axis of rotation of the inner flank.

5. The comminution device according to claim 1, wherein the angle to the axis of rotation of the radially outer flank of at least one radially outer jag is greater than the angle to the axis of rotation of the radially outer flank of a radially inner jag.

6. The comminution device according to claim 5, wherein the angle to the axis of rotation of the radially outer flanks of the radially outer jags is respectively greater than the angle to the axis of rotation of the radially outer flanks of the radially inner jags.

7. The comminution device according to claim 1, wherein the second cutting element is mounted on an axially displaceable hub, and wherein an axial position of the hub is adjustable and releasably fixed within the comminution device.

8. The comminution device according to claim 7, wherein the device comprises a first screw for defining the axial position of the hub and a lock screw for fixing the axial position.

9. The comminution device according to claim 1, further comprising a plurality of third cutting elements having third serrated cutting edges disposed on a third circular path.

10. The comminution device according to claim 9, wherein the third circular path is concentric with the first circular path and has the same diameter.

11. The comminution device according to claim 9, wherein the second cutting element comprises a fourth serrated cutting edge corresponding to the third serrated cutting edges for cutting through the cutting material.

12. The comminution device according to claim 11, wherein the second cutting edge and the fourth cutting edge are implemented substantially mirror-symmetrical.

13. The comminution device according to claim 3, wherein an axial position of the plurality of third cutting elements relative the axial position of the second cutting element is axially adjusted in the direction of the axis of rotation by a second adjustment mechanism, such that a second cutting gap between them is adjustable.

14. The comminution device according to claim 13, wherein the third cutting elements are mounted in a housing, and wherein an axial position of the housing is adjustable and releasably fixed within the comminution device.

15. The comminution device according to claim 14, wherein the device for determining the axial position of the housing comprises a first screw for defining an axial position of the housing and a lock screw for fixing the axial position of the housing.

16. The comminution device according to claim 1, further comprising a pre-comminutor disposed upstream of the first and second cutting elements and comprising:

a first pre-cutting element comprising at least one first pre-cutting edge; and a second pre-cutting element displaceable on a second pre-cutting element circular path relative to the first pre-cutting element, the second pre-cutting element comprising at least one second precut edge;

wherein the second pre-cutting element is coupled to the drive for rotationally driving the second cutting element.

17. The comminution device according to claim 1, wherein the at least one second cutting element is disposed at an angle to the axis of rotation.

18. The comminution device according to claim 17, wherein the at least one second cutting element encloses an angle with the axis of rotation in a range of >0° to 90°.

19. The comminution device according to claim 18, wherein the at least one second cutting element encloses an angle with the axis of rotation in a range of >0° to 45°.

20. The comminution device according to claim 19, wherein the at least one second cutting element encloses an angle with the axis of rotation in a range of 5° to 45°.

21. The comminution device according to claim 17, wherein the second cutting element is mounted on a hub, wherein the hub comprises at least one radial recess having a mounting surface disposed at an angle to the axis of rotation, wherein the second cutting element is mounted on the mounting surface.

22. The comminution device according to claim 1, wherein the at least one second cutting element comprises a passage for reducing a flow resistance.

23. A comminution device, comprising:

a plurality of first cutting elements having first serrated cutting edges disposed on a first circular path; and a second cutting element having a second serrated cutting edge corresponding to the first serrated cutting edges for cutting through a cutting material, the second cutting element being displaceable about a rotational axis on a second circular path concentric with the first circular path, the second serrated cutting edge comprising a plurality of jags and each jag comprising a radially inner flank and a radially outer flank, each of the radially inner flank and the radially outer flank at an angle to the axis of rotation;

a plurality of third cutting elements having third serrated cutting edges disposed on a third circular path, wherein the third circular path is concentric with the first circular path and has the same diameter;

a fourth serrated cutting edge disposed on the second cutting element and corresponding to the third serrated cutting edges;

a drive for rotationally driving the second cutting element about the axis of rotation; and a first adjustment mechanism by which an axial position of the plurality of first cutting elements relative an axial position of the second cutting element is axially adjusted in the direction of the axis of rotation such that a first cutting gap between the first cutting elements and the second cutting element is adjustable, and a second adjustment mechanism by which an axial position of the plurality of third cutting elements relative an axial position of the second cutting element is axially adjusted in the direction of the axis of rotation such that a second cutting gap between the third cutting elements and the second cutting element is adjustable.

* * * * *